US010190775B2

(12) United States Patent
Miyauchi et al.

(10) Patent No.: US 10,190,775 B2
(45) Date of Patent: Jan. 29, 2019

(54) COMBUSTOR AND GAS TURBINE HAVING THE SAME

(71) Applicant: MITSUBISHI HITACHI POWER SYSTEMS, LTD., Kanagawa-ken (JP)

(72) Inventors: Kotaro Miyauchi, Yokohama (JP); Koichi Nishida, Yokohama (JP); Shinji Akamatsu, Yokohama (JP); Keijiro Saito, Tokyo (JP); Satoshi Takiguchi, Tokyo (JP); Toshihiko Saito, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 450 days.

(21) Appl. No.: 14/860,980

(22) Filed: Sep. 22, 2015

(65) Prior Publication Data

US 2016/0091207 A1 Mar. 31, 2016

(30) Foreign Application Priority Data

Sep. 29, 2014 (JP) ..... 2014-197826

(51) Int. Cl.
*F23R 3/28* (2006.01)
*F23R 3/46* (2006.01)

(52) U.S. Cl.
CPC ..... *F23R 3/286* (2013.01); *F23R 3/283* (2013.01); *F23R 3/46* (2013.01); *F23R 2900/03041* (2013.01)

(58) Field of Classification Search
CPC ... F23R 3/283; F23R 3/286; F23R 3/10–3/14; F23D 11/40–11/408
See application file for complete search history.

(56) References Cited

U.S. PATENT DOCUMENTS 5,675,971 A * 10/1997 Angel ..... F23R 3/286 239/405
7,185,497 B2 * 3/2007 Dudebout ..... F23R 3/286 60/737
8,113,000 B2 * 2/2012 Laster ..... F23R 3/286 60/39.11
8,387,393 B2 * 3/2013 Landry ..... F02C 7/22 60/737

(Continued)

FOREIGN PATENT DOCUMENTS

JP 2006-078127 3/2006
JP 2014-16151 1/2014

(Continued)

*Primary Examiner* — Todd E Manahan
*Assistant Examiner* — Rene Ford
(74) *Attorney, Agent, or Firm* — Wenderoth, Lind & Ponack, L.L.P.

(57) ABSTRACT

A combustor is equipped with a burner case, and a base plate spreading from a downstream end of the burner case in a radial direction. The base plate defines a purging air space at an upstream side of the base plate. The combustor includes a purging air flow passage configured to inject purging air in the purging air space to a downstream side relative to the base plate. An outflow opening of the purging air flow passage is defined within at least one of a radial range from an inner circumferential surface of the burner case and an axial range from the downstream end of the burner case.

11 Claims, 14 Drawing Sheets

(56) References Cited

U.S. PATENT DOCUMENTS

| | | | | |
|---|---|---|---|---|
| 8,438,851 | B1 * | 5/2013 | Uhm | F23R 3/04 60/737 |
| 2010/0064691 | A1 | 3/2010 | Laster et al. | |
| 2014/0013764 | A1 | 1/2014 | Biagioli et al. | |

FOREIGN PATENT DOCUMENTS

| | | |
|---|---|---|
| JP | 2014-122784 | 7/2014 |
| JP | 2014-153052 | 8/2014 |

* cited by examiner

COMBUSTOR AND GAS TURBINE HAVING THE SAME

CROSS-REFERENCE TO RELATED APPLICATION

Priority is claimed from Japanese Patent Application No. 2014-197826, filed on Sep. 29, 2014, the content of which is incorporated herein by reference.

BACKGROUND OF THE INVENTION

Field of the Invention

The present invention relates to a combustor and a gas turbine having the same.

Description of Related Art

For example, a combustor disclosed in Japanese Unexamined Patent Application Publication No. 2006-078127 is equipped with a plurality of burners, and a combustion liner that forms a combustion zone in which fuel jetting out from the plurality of burners is burnt. Each of the plurality of burners has a nozzle that injects the fuel, and a burner case that injects air and the fuel from the nozzle to the downstream side. The nozzle has a rod-like portion. The burner case surrounds an outer circumference of the nozzle. The combustor is further equipped with a base plate that spreads in a radial direction based on an axis of the burner case.

In the combustor, the fuel is burnt, and a combustion gas produced as a result of the burning flows. For this reason, the combustor has a plurality of components under a high-temperature environment. Thus, it is desirable for the combustor including such components to have an increased service life.

SUMMARY OF THE INVENTION

Thus, an object of the present invention is to provide a combustor capable of achieving an increase in service life, and a gas turbine having the same.

To accomplish the object, a combustor of a first aspect according to the invention includes: a nozzle having a rod-like portion centered on a burner axis and configured to inject fuel; a burner case configured to form a tubular shape, to surround an outer circumference of the nozzle, and to inject air and the fuel from the nozzle from an upstream side that is one side in an axial direction in which the burner axis extends to a downstream side that is the other side; and a base plate spreading from a downstream end of the burner case in a direction having a component of a radial direction based on the burner axis and configured to define a purging air space, into which the purging air flows, at an outer circumferential side of the burner case which is an upstream side of the base plate. A purging air flow passage injecting the purging air in the purging air space into the burner case or to a downstream side relative to the base plate is formed in at least one of the base plate and the burner case. An outflow opening of the purging air flow passage which injects the purging air is formed within an opening formation range, and the opening formation range is made up of a range from the downstream end of the burner case to an opening formation range dimension, which is one of a plate thickness dimension of a case forming plate forming the burner case and a plate thickness dimension of the base plate, toward the upstream side, and a range from an inner circumferential surface of the burner case to the opening formation range dimension in the radial direction.

In the combustor, the purging air from the purging air space is injected from the outflow opening of the purging air flow passage formed within the opening formation range into the burner case or to the downstream side relative to the base plate. For this reason, in the combustor, vortexes of a combustible gas including the fuel are rarely formed in the downstream side of the downstream end of the burner case. Further, even if a part of the combustible gas injected from the burner case drifts in the vicinity of the downstream end of the burner case, a combustible content of the combustible gas is diluted with the purging air. In other words, the purging air from the purging air flow passage drifts in the vicinity of the downstream end of the burner case, and the combustible content of the combustible gas drifting in the vicinity of the downstream end of the burner case is reduced.

Therefore, in the combustor, combustion of the combustible gas in the vicinity of the downstream end of the burner case can be suppressed.

To accomplish the object, a combustor of a second aspect according to the invention may be configured such that, in the combustor of the first aspect, the outflow opening of the purging air flow passage is formed within a first opening formation range, and the first opening formation range is made up of a range from the downstream end of the burner case to a first opening formation range dimension, which is a longer one of the plate thickness dimension of the case forming plate forming the burner case and the plate thickness dimension of the base plate, toward the upstream side, and a range from the inner circumferential surface of the burner case to the first opening formation range dimension in the radial direction.

To accomplish the object, a combustor of a third aspect according to the invention may be configured such that, in the combustor of the first aspect, the outflow opening of the purging air flow passage is formed within a second opening formation range, and the second opening formation range is made up of a range from the downstream end of the burner case to a second opening formation range dimension, which is a shorter one of the plate thickness dimension of the case forming plate forming the burner case and the plate thickness dimension of the base plate, toward the upstream side, and a range from the inner circumferential surface of the burner case to the second opening formation range dimension in the radial direction.

In the combustor, the purging air from the purging air space is injected from the outflow opening of the purging air flow passage formed within the second opening formation range into the burner case or to the downstream side relative to the base plate. In the second opening formation range, a dimension from the downstream end of the burner case to a limit position of the second opening formation range toward the upstream side and a dimension from the inner circumferential surface of the burner case to a limit position of the second opening formation range in the radial direction are shorter than corresponding dimensions of the first opening formation range. For this reason, in the combustor, an amount in which the purging air from the purging air flow passage drifts is increased in the vicinity of the downstream end of the burner case, and the combustible content of the combustible gas in the vicinity of the downstream end of the burner case is further reduced.

Here, in the combustor of any one of the first to third aspects, the outflow opening may be formed in an annular shape centered on the burner axis.

In the combustor, the amount of combustible gas drifting in the vicinity of the downstream end of the burner case can be reduced throughout the circumference of the downstream end of the burner case.

In the combustor of any one of the first to third aspects, a plurality of outflow openings may be formed away from each other in a circumferential direction centered on the burner axis.

In the combustor of any one of the foregoing aspects, a plurality of at least one openings of inflow openings into which the purging air flows and outflow openings of the purging air flow passage may be formed away from each other in a circumferential direction centered on the burner axis, and the plurality of one openings may be each formed in a circular arc shape centered on the burner axis.

In the combustor, since a portion between each two of the plurality of one openings forms a spacer for securing an interval between inner and outer circumferential edges of each of the one openings having the circular arc shape, it is possible to easily secure the interval between the inner and outer circumferential edges of each of the one openings.

In the combustor in which the plurality of at least one openings of the inflow openings and the outflow openings are formed away from each other in the circumferential direction, the portion between each two of the plurality of one openings in the circumferential direction may form a spacer for securing an interval between inner and outer circumferential edges of each of the one openings having the circular arc shape, and as the spacer approaches the outflow opening from a side of the purging air space, a width thereof in the circumferential direction may be gradually reduced.

In this combustor, it is possible to reduce the vortexes formed at the downstream side of the spacers. The downstream side here is a downstream side to which the purging air in the purging air flow passage flows.

In the combustor of any one of the foregoing aspects, the outflow opening may be formed to straddle the base plate and the burner case.

In this combustor, an amount in which the purging air from the purging air flow passage drifts can be increased in the vicinity of the downstream end of the burner case, and the combustible content of the combustible gas drifting in the vicinity of the downstream end of the burner case can be further reduced.

In the combustor of any one of the foregoing aspects, the outflow opening may be formed in the burner case.

In this combustor, an amount in which the purging air from the purging air flow passage drifts can be increased in the vicinity of the downstream end of the burner case, and the combustible content of the combustible gas drifting in the vicinity of the downstream end of the burner case can be further reduced.

In the combustor of any one of the foregoing aspects, the outflow opening may be formed in the base plate.

In the combustor of any one of the foregoing aspects, as the purging air flow passage approaches the outflow opening from the side of the purging air space, the purging air flow passage may be gradually inclined to be nearer the burner axis.

In this combustor, the purging air is injected in a direction gradually approaching the burner axis from the outflow opening toward the downstream side. For this reason, in the combustor, the combustible gas injected from the burner case can be inhibited from being spread in the radial direction relative to the burner axis. Therefore, in the combustor, the combustible content of the combustible gas drifting in the vicinity of the downstream end of the burner case can be further reduced.

In the combustor of any one of the foregoing aspects, the downstream end of the burner case may be formed with a tapered surface such that an inner diameter thereof is gradually increased toward the downstream side, and a tapered surface formation width of the tapered surface in a plate thickness direction of the case forming plate forming the burner case may be equal to or more than half of a plate thickness of a portion at which the tapered surface is not formed in the case forming plate.

In this combustor, even just after the combustible gas inside the burner case is injected from the burner case, most of the combustible gas smoothly flows toward the downstream side. For this reason, in the combustor, the vortexes formed at the downstream side of the downstream end of the burner case can be reduced.

In the combustor of any one of the foregoing aspects, the base plate may be formed with a plurality of purging air holes penetrating from the purging air space to the downstream side of the base plate.

In this combustor, thermal damage to the base plate can be suppressed.

In the combustor of any one of the foregoing aspects, an area of the outflow opening per unit length in a circumferential direction may be enlarged in a zone in which a fuel concentration in the circumferential direction centered on the burner axis is relatively high at the downstream side of the burner case.

In this combustor, a flow rate of the purging air injected from the outflow opening can be increased in the zone in which the fuel concentration is relatively high in the circumferential direction centered on the burner axis at the downstream side of the burner case. For this reason, in the combustor, a possibility of flames being formed in the vicinity of the downstream end of the burner case can be reduced.

To accomplish the object, a combustor as another aspect according to the invention includes: a nozzle having a rod-like portion centered on a burner axis and configured to inject fuel; a burner case configured to form a tubular shape, to surround an outer circumference of the nozzle, and to inject air and the fuel from the nozzle from an upstream side that is one side in an axial direction in which the burner axis extends to a downstream side that is the other side; and a base plate spreading from a downstream end of the burner case in a direction having a component of a radial direction based on the burner axis and configured to define a purging air space, into which the purging air flows, at an outer circumferential side of the burner case which is an upstream side of the base plate. The base plate is formed with a plurality of purging air holes penetrating from the purging air space to the downstream side of the base plate. A downstream end of the burner case is formed with a tapered surface such that an inner diameter thereof is gradually increased toward the downstream side, and a tapered surface formation width of the tapered surface in a plate thickness direction of the case forming plate forming the burner case is equal to or more than half of a plate thickness of a portion at which the tapered surface is not formed in the case forming plate.

In this combustor, even just after a combustible gas inside the burner case is injected from the burner case, most of the combustible gas smoothly flows toward the downstream side. For this reason, in the combustor, vortexes formed at the downstream side of the downstream end of the burner case can be reduced. In addition, in the combustor, purging air of the purging air space is injected to the downstream side of the base plate. Therefore, in the combustor, combustion of the combustible gas in the vicinity of the downstream end of the burner case can be suppressed.

To accomplish the object of the present invention, a gas turbine of an aspect according to the invention includes: the combustor of any one of the foregoing aspects; a compressor configured to compress air and supply the air to the combustor; and a turbine driven by a combustion gas formed by combustion of the fuel in the combustor.

In an aspect according to the invention, thermal damage to the burner case can be suppressed, and the service life of the combustor can be increased.

DETAILED DESCRIPTION OF THE INVENTION

Hereinafter, an embodiment of a gas turbine according to the present invention and further various modifications of a combustor with which the gas turbine is equipped will be described in detail with reference to the drawings.

(Embodiment)

An embodiment of a gas turbine according to the present invention will be described using FIGS. 1 to 6.

Figure 1:
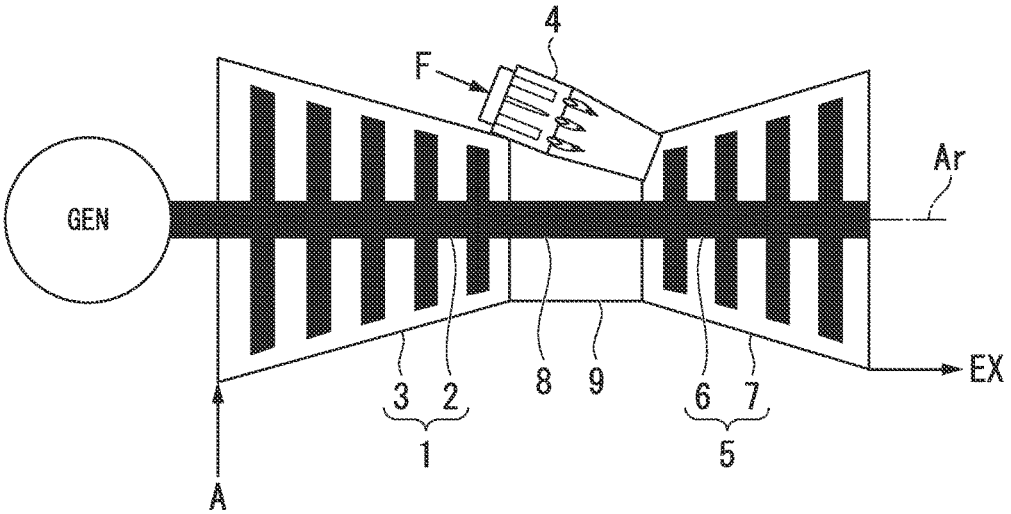
FIG. 1 is a schematic view showing a constitution of a gas turbine in an embodiment of the present invention.

As shown in FIG. 1, the gas turbine of the present embodiment is equipped with a compressor 1 that compresses ambient air to produce compressed air, a plurality of combustors 4 that burn fuel F in the compressed air to produce a combustion gas, and a turbine 5 that is driven by the combustion gas.

The compressor 1 has a compressor rotor 2 that rotates about a rotational axis Ar, and a compressor casing 3 that rotatably covers the compressor rotor 2. The turbine 5 has a turbine rotor 6 that rotates about a rotational axis Ar, and a turbine casing 7 that rotatably covers the turbine rotor 6. The rotational axis Ar of the compressor rotor 2 and the rotational axis Ar of the turbine rotor 6 are located on the same straight line. The compressor rotor 2 and the turbine rotor 6 are connected together to form a gas turbine rotor 8. Also, the compressor casing 3 and the turbine casing 7 are connected together to form a gas turbine casing 9.

For example, a rotor of a generator is connected to the gas turbine rotor 8. The combustor 4 is fixed to the gas turbine casing 9.

Figure 2:
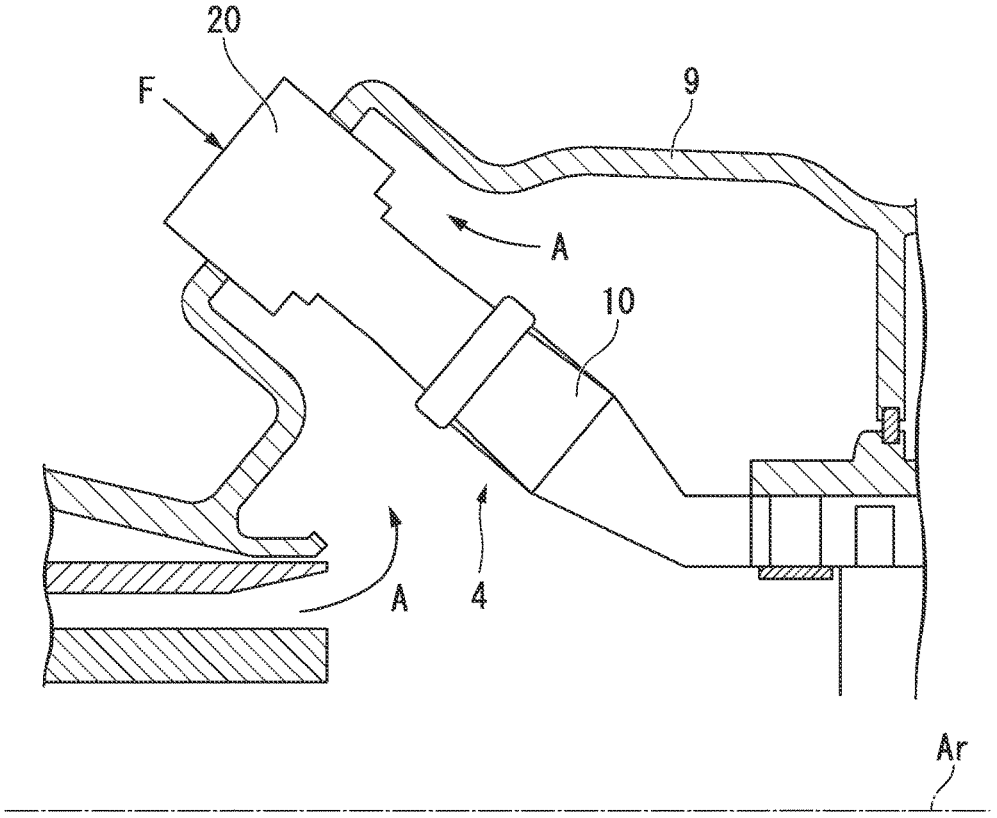
FIG. 2 is a sectional view around a combustor of the gas turbine in the embodiment of the present invention.

As shown in FIG. 2, the combustor 4 has a combustion liner (or a transition piece) 10, and a fuel injector 20. The fuel F is burnt inside the combustion liner 10, and the combustion gas produced as a result of the combustion of the fuel F is sent to a combustion gas flow passage of the turbine 5 by the combustion liner 10. The fuel injector 20 injects the fuel F and air A into the combustion liner 10.

Figure 3:
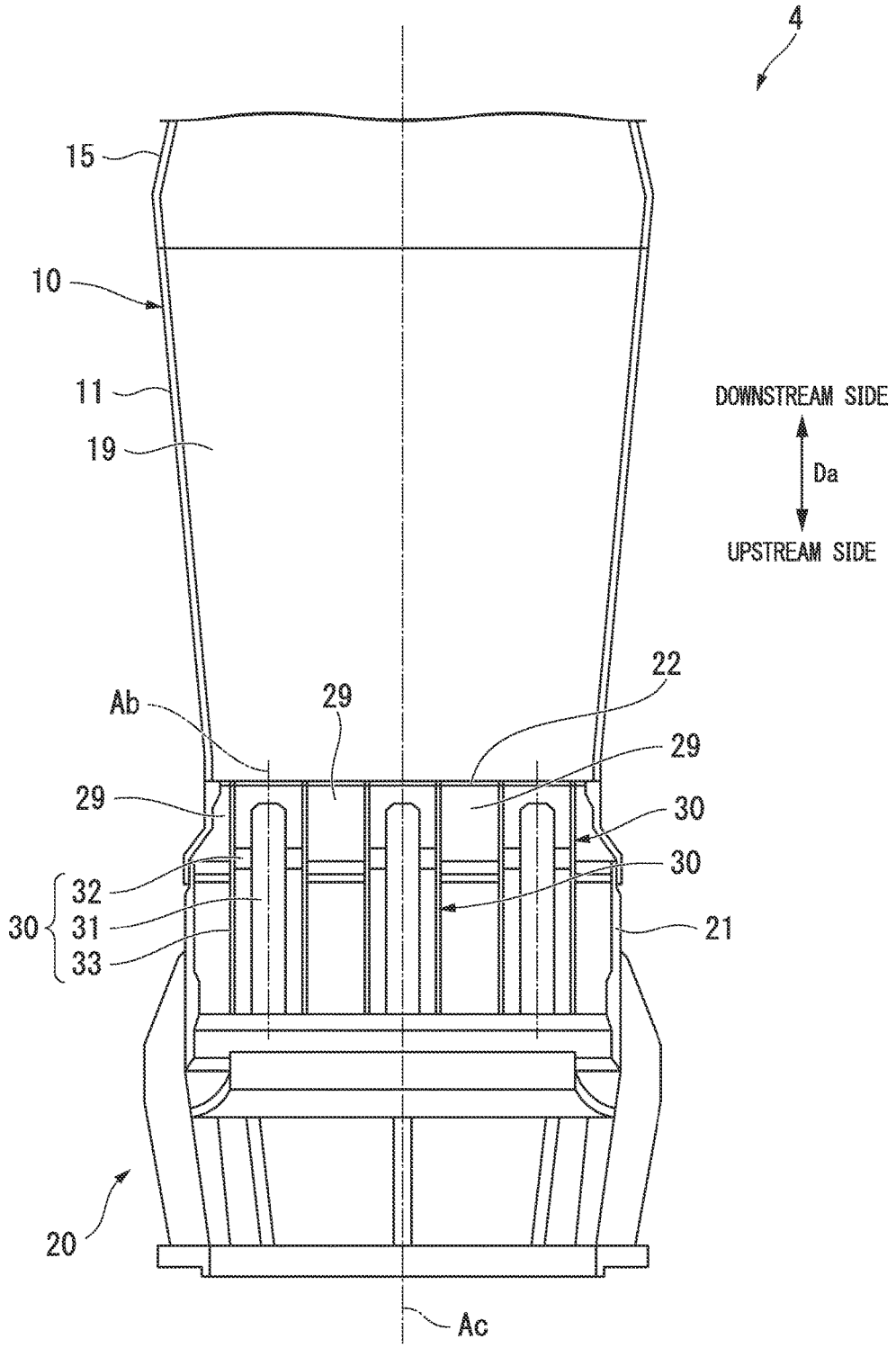
FIG. 3 is a sectional view of the combustor in the embodiment of the present invention.

As shown in FIG. 3, the combustion liner 10 has a combustion section 11 that forms a combustion zone 19 in which the fuel jetting out from the fuel injector 20 is burnt, and a combustion gas guide section 15 that guides the combustion gas produced by the combustion of the fuel to the combustion gas flow passage of the turbine 5. The combustion section 11 has a cylindrical shape centered on a combustor axis Ac. The combustion gas guide section 15 has a tubular shape. Here, a direction in which the combustor axis Ac extends is defined as an axial direction Da, one side of the axial direction Da is defined as an upstream side, and the other side of the axial direction Da is defined as a downstream side. The combustion gas guide section 15 of the combustion liner 10 is formed at the downstream side of the combustion section 11 of the combustion liner 10.

The fuel injector 20 is equipped with a plurality of burners 30 that inject air along with fuel, and a burner holding case 21 that holds the plurality of burners 30.

Each of the burners 30 has a rod-like nozzle 31 that extends in the axial direction Da centered on a burner axis Ab parallel to the combustor axis Ac, a burner case 33 that covers an outer circumference of the nozzle 31, and a plurality of swirl plates 32 that cause the compressed air to swirl about the burner axis Ab.

The nozzle 31 is formed with an injection hole for injecting fuel. The nozzle 31 is provided with a plurality of swirl plates 32. Each of the swirl plates 32 extends from the outer circumference of the nozzle 31 in a direction including a radial component, and is connected to an inner circumferential surface of the burner case 33. The compressed air compressed by the compressor 1 flows into the burner case 33 from the upstream side of the burner case 33. The burner case 33 injects the fuel injected from the nozzle 31 from a downstream end thereof along with the compressed air.

All of the plurality of burners 30 may be premix burners that pre-mix the fuel and the air in the burner cases 33 to inject these as a pre-mixed gas. Alternatively, all of the plurality of burners 30 may be diffusion burners that inject the fuel and the air without pre-mixing them in the burner cases 33. Also, among the plurality of burners 30, some may be the premix burners, and the others may be the diffusion burners.

When the burners 30 are the premix burners, injection holes for injecting the fuel may be formed in the swirl plates 32, and the fuel may be injected into the burner cases 33 through these injection holes. In this case, portions corresponding to the rod-like nozzles 31 described above form hub rods. Also, in this case, each of the nozzles is formed with the hub rod and the plurality of swirl plates 32. The fuel is supplied into the hub rod from the outside, and to the swirl plates 32 from the hub rod. Thus, the burners 30 inject a combustible gas including the fuel and the air regardless of whether they are the premix burners or the diffusion burners.

The fuel injector 20 is further equipped with a base plate 22 that spreads from a downstream end of each burner case 33 in a radial direction based on each burner axis Ab. The base plate 22 has a disc shape centered on the combustor axis Ac, and an outer circumferential edge thereof is connected to the burner holding case 21. The base plate 22 defines a purging air space 29, into which purging air Pa flows, at an outer circumferential side of the burner case 33 which is an upstream side of the base plate 22, and defines the above-described combustion zone 19 at the downstream side thereof.

Figure 4:
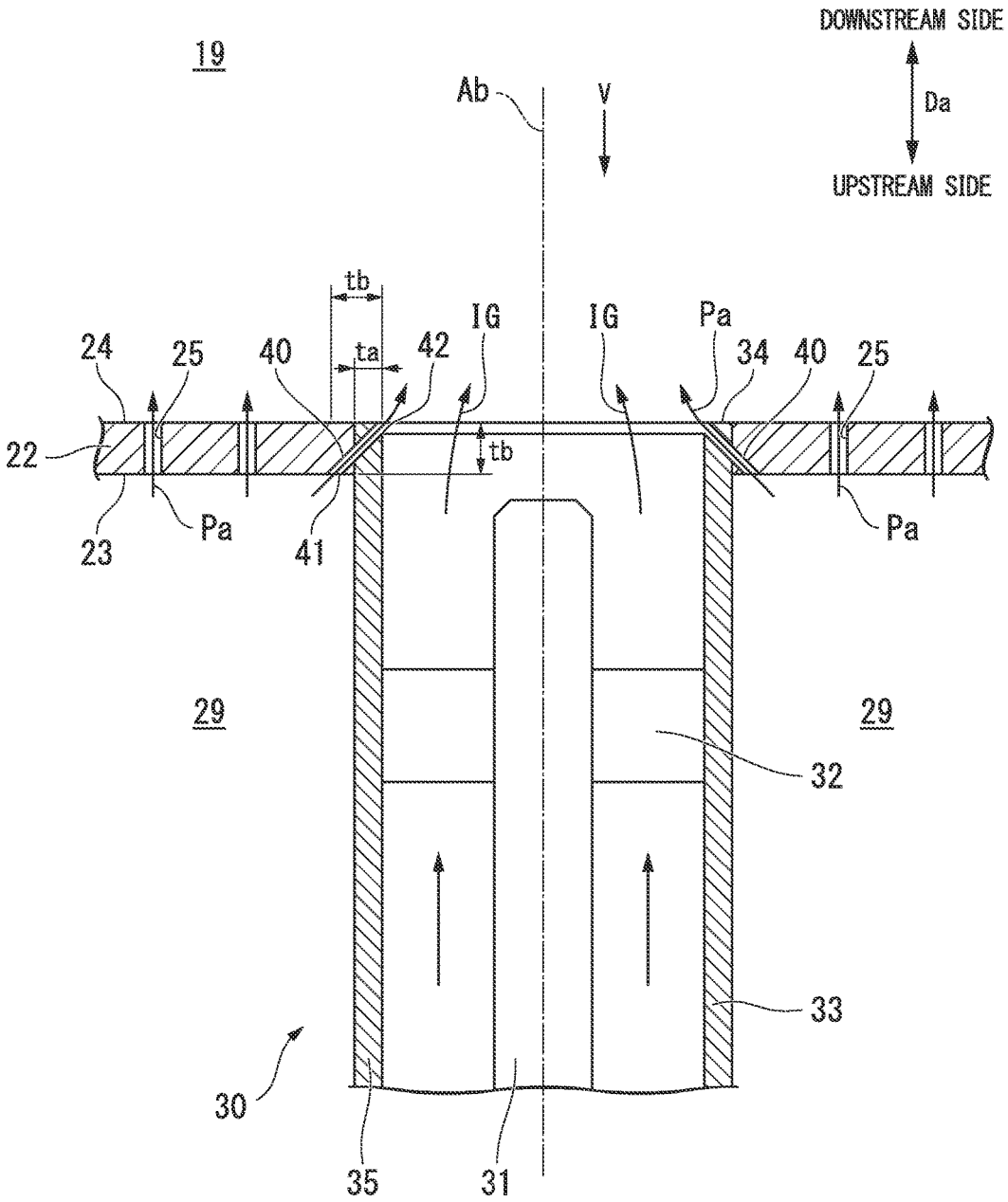
FIG. 4 is a sectional view of the combustor around a burner in the embodiment of the present invention.
Figure 5:
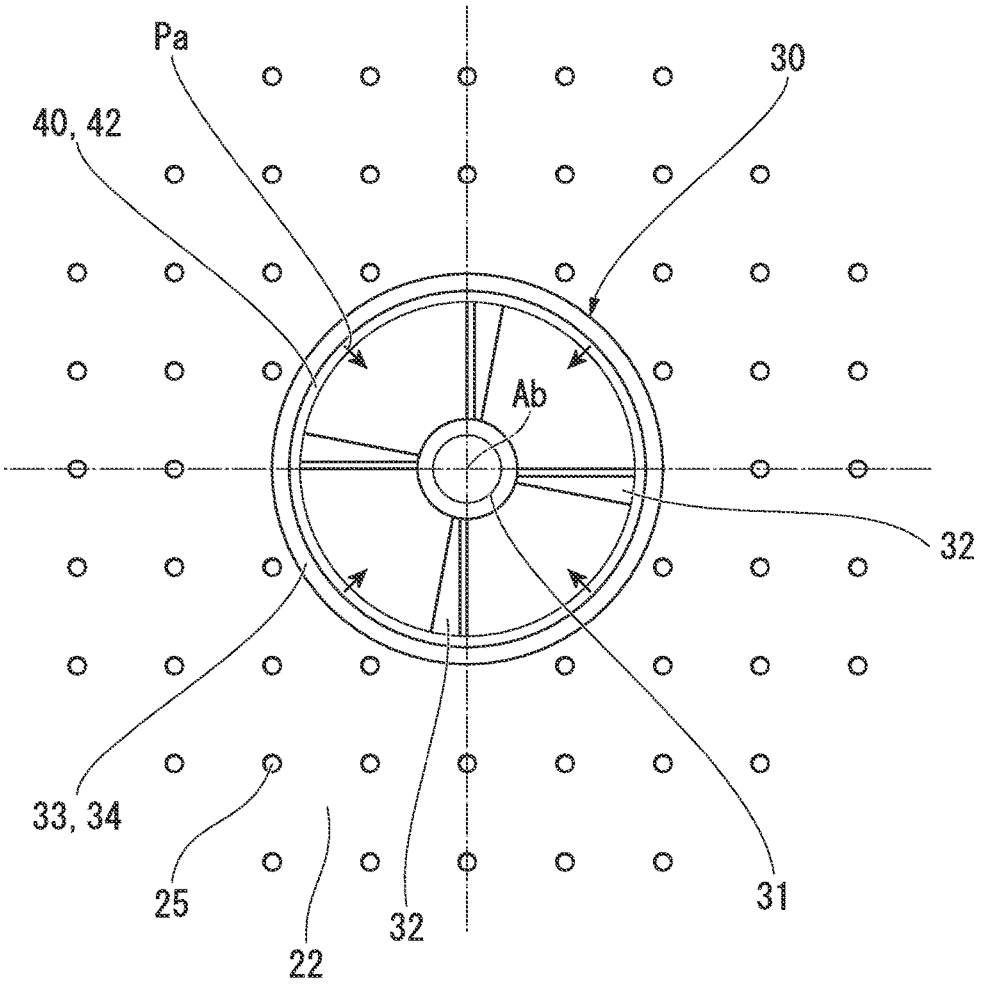
FIG. 5 is a view from the direction of arrow V FIG. 4.

As shown in FIGS. 4 and 5, the base plate 22 is formed with a plurality of purging air holes 25 that penetrate from the purging air space 29 to the combustion zone 19. Further, the base plate 22 and each burner case 33 share a purging air slit (purging air flow passage) 40 that penetrates from the purging air space 29 to the combustion zone 19 so as to straddle the base plate 22 and each burner case 33. An inflow opening 41 that is an opening of the purging air slit 40 which is located at the side of the purging air space 29 is formed in an upstream-side surface 23 of the base plate 22. An outflow opening 42 of the purging air slit 40 is formed in a corner of the downstream end of the burner case 33.

The purging air slit 40 has a tubular shape centered on the burner axis Ab. Therefore, both the inflow and outflow openings 41 and 42 of the purging air slit 40 have annular shapes centered on the burner axis Ab. A flow passage within a virtual plane including the burner axis Ab of the purging air slit 40 is linear and gradually inclined to be nearer the burner axis Ab from the inflow opening 41 toward the outflow opening 42.

As described above, the outflow opening 42 is formed in the corner of the downstream end of the burner case 33, i.e. in a corner at which an inner circumferential surface of the burner case 33 and a downstream end face 34 of the burner case 33 meet. Therefore, the outflow opening 42 is formed within a first opening formation range composed of a range from the downstream end face 34 of the burner case 33 to a first opening formation range dimension tb toward the upstream side and a range from the inner circumferential surface of the burner case 33 to the first opening formation range dimension tb in the radial direction. The first opening formation range dimension is a plate thickness dimension that is a longer one of a plate thickness dimension ta of a case forming plate 35 forming the burner case 33 and a plate thickness dimension tb of the base plate 22. The plate thickness dimension ta of the case forming plate 35 is shorter than the plate thickness dimension tb of the base plate 22. Therefore, the first opening formation range dimension here is the plate thickness dimension tb of the base plate 22. Further, the outflow opening 42 is formed within a second opening formation range composed of a range from the downstream end face 34 of the burner case 33 to a second opening formation range dimension ta toward the upstream side and a range from the inner circumferential surface of the burner case 33 to the second opening formation range dimension ta in the radial direction. The second opening formation range dimension is a plate thickness dimension that is a shorter one of the plate thickness dimension ta of the case forming plate 35 forming the burner case 33 and the plate thickness dimension tb of the base plate 22. Therefore, the second opening formation range dimension here is the plate thickness dimension ta of the case forming plate 35.

Figure 6:
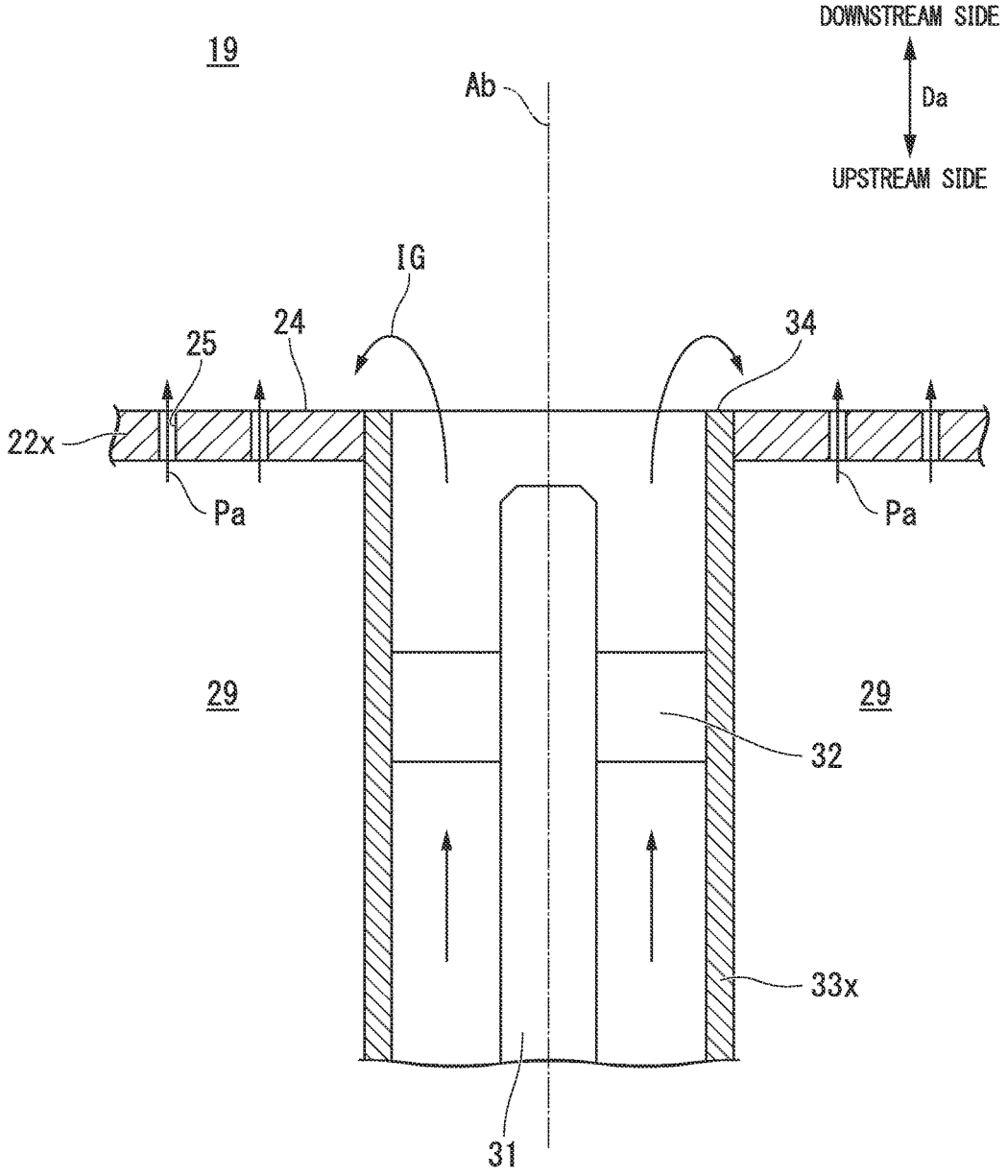
FIG. 6 is a sectional view of a combustor around a burner in a comparative example.

Here, a flow of a gas in a comparative example in which no purging air slit is formed in the burner case 33 and the base plate 22 will be described using FIG. 6.

A combustible gas IG is injected from a burner case 33*x* of the comparative example into the combustion zone 19 of the combustion liner 10 (see FIG. 3).

When no purging air slit is formed in the burner case 33*x* and a base plate 22*x*, vortexes of the combustible gas IG flowing through the interior of the burner case 33*x* are formed at the downstream side of the downstream end face 34 of the burner case 33*x*.

In this way, when the vortexes of the combustible gas IG are formed at the downstream side of the downstream end face 34 of the burner case 33*x*, a possibility of flames being formed in the vicinity of the downstream end face 34 of the burner case 33*x* and a downstream-side surface 24 of the base plate 22*x* which is adjacent to the burner case 33*x* is increased. Further, depending on an operation condition of the combustor, the flames are sometimes formed in the vicinity of the downstream end face 34 of the burner case 33*x* and the downstream-side surface 24 of the base plate 22*x* which is adjacent to the burner case 33*x*. For this reason, in the comparative example, the downstream end of the burner case 33*x* and a portion of the base plate 22*x* which is adjacent to the burner case 33*x* are under a high-temperature environment. Therefore, in the comparative example, the burner case 33*x* and the base plate 22*x* are subjected to thermal damage, and service lives thereof are reduced.

On the other hand, in the present embodiment, the purging air slit 40 straddling the burner case 33 from the base plate 22 is formed, and further, the outflow opening 42 thereof is formed in the corner of the downstream end of the burner case 33. Moreover, the flow passage within the virtual plane including the burner axis Ab of the purging air slit 40 is gradually inclined to be nearer the burner axis Ab from the inflow opening 41 toward the outflow opening 42. For this reason, the purging air Pa from the purging air space 29 is injected from the corner of the downstream end of the burner case 33 into the combustion zone 19 in a direction gradually approaching the burner axis Ab toward the downstream side. Therefore, in the present embodiment, no vortexes of the combustible gas IG are substantially formed at the downstream side of the downstream end face 34 of the burner case 33, and the combustible gas IG injected from the burner case 33 can be inhibited from being spread in the radial direction relative to the burner axis Ab. Even if a part of the combustible gas IG injected from the burner case 33 drifts in the vicinity of the downstream end face 34 of the burner case 33, a combustible content of the combustible gas IG is diluted with the purging air Pa. In other words, the purging air Pa from the purging air slit 40 drifts near the downstream end of the burner case 33, and the combustible content of the combustible gas IG drifting near the downstream end of the burner case 33 is reduced.

Therefore, in the present embodiment, it is possible to suppress the combustion of the combustible gas IG in the vicinity of the downstream end of the burner case 33. For this reason, in the present embodiment, the burner case 33 and the base plate 22 can be inhibited from being thermally damaged, and the service lives thereof can be increased.

(First Modification of Combustor)

Figure 7:
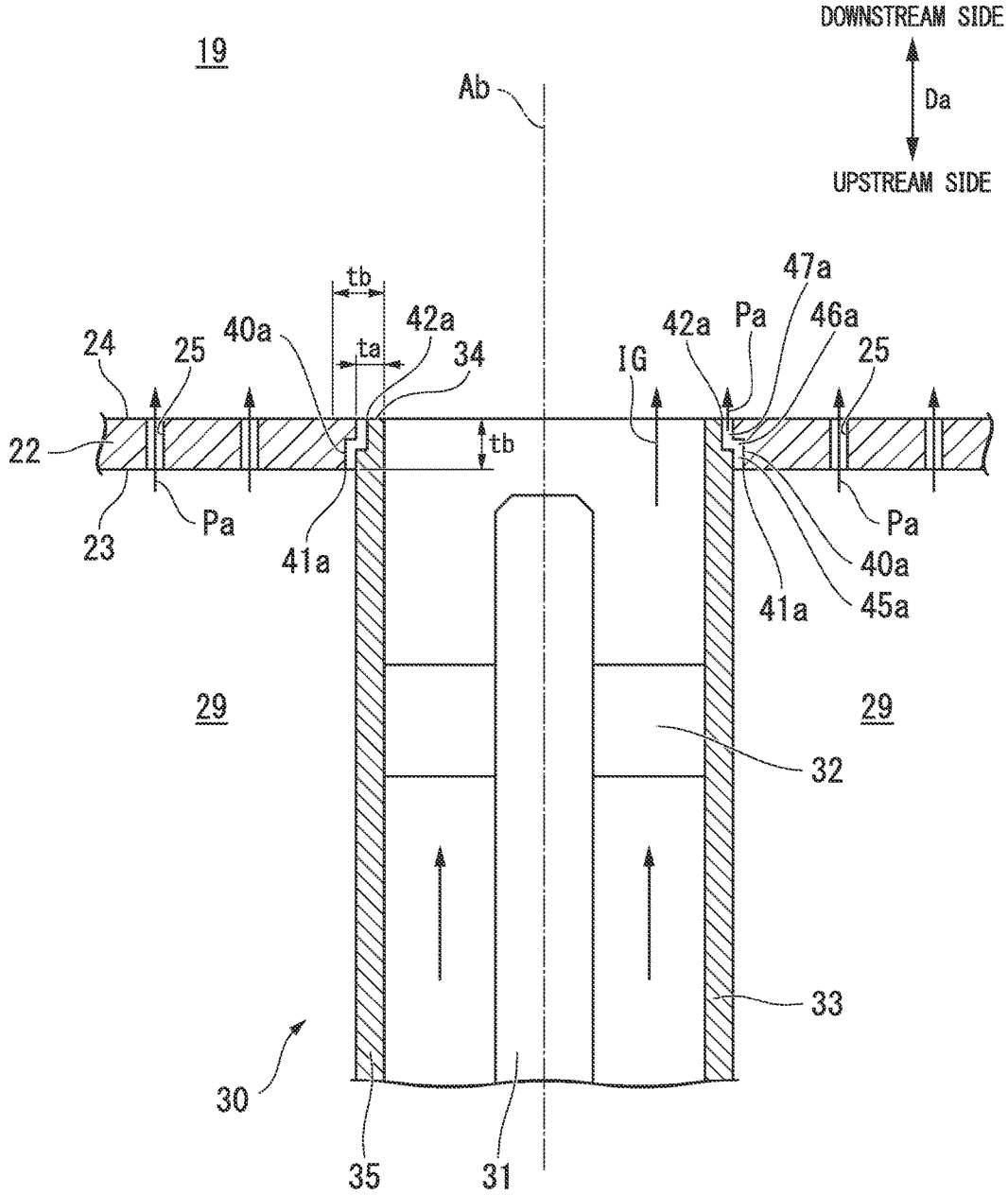
FIG. 7 is a sectional view of a combustor around a burner in a first modification of the present invention.

A first modification of the combustor in the above-described embodiment will be described using FIG. 7.

In the combustor of the present modification, only the shape of the purging air slit 40 in the combustor of the above embodiment is changed, and thus the other constitutions are the same as those of the combustor of the embodiment.

An inflow opening 41*a* of a purging air slit 40*a* in the present modification is formed in the upstream-side surface 23 of the base plate 22. An outflow opening 42*a* of the purging air slit 40*a* is formed in the downstream end face 34 of the burner case 33. Therefore, like the above embodiment, the outflow opening 42*a* is formed within a second opening formation range from the inner circumferential surface of the burner case 33 to a position corresponding to the plate thickness dimension to of the case forming plate 35 in the radial direction.

The purging air slit 40*a* is formed with a first flow passage 45*a*, a second flow passage 46*a*, and a third flow passage 47*a*. The first flow passage 45*a* extends in the base plate 22 from the inflow opening 41*a* toward the downstream side. The second flow passage 46*a* extends in the base plate 22 and the case forming plate 35 forming the burner case 33 from a downstream end of the first flow passage 45*a* toward a radially inner side relative to the burner axis Ab. The third flow passage 47*a* extends in the case forming plate 35 from a radially inner end of the second flow passage 46*a* toward the downstream side, and has the outflow opening 42*a* as an opening. That is, the purging air slit 40*a* is configured such that a flow passage within a virtual plane including the burner axis Ab is formed in a crank shape.

In the present modification, the purging air slit 40*a* straddling the burner case 33 from the base plate 22 is formed, and further, the outflow opening 42*a* thereof is formed in the downstream end face 34 of the burner case 33. Moreover, the third flow passage 47*a* having the outflow opening 42*a* as the opening extends toward the downstream side. For this reason, the purging air Pa from the purging air space 29 is injected from the downstream end face 34 of the burner case 33 into the combustion zone 19 toward the downstream side. In the present modification as well, like the embodiment described above, no vortexes of the combustible gas IG are substantially formed at the downstream side of the downstream end face 34 of the burner case 33, and the combustible gas IG injected from the burner case 33 can be inhibited from being spread in the radial direction relative to the burner axis Ab. Even if a part of the combustible gas IG injected from the burner case 33 drifts in the vicinity of the downstream end face 34 of the burner case 33, a combustible content of the combustible gas IG is diluted with the purging air Pa.

Therefore, in the present modification as well, the burner case 33 and the base plate 22 can be inhibited from being thermally damaged, and service lives thereof can be increased.

(Second Modification of Combustor)

Figure 8:
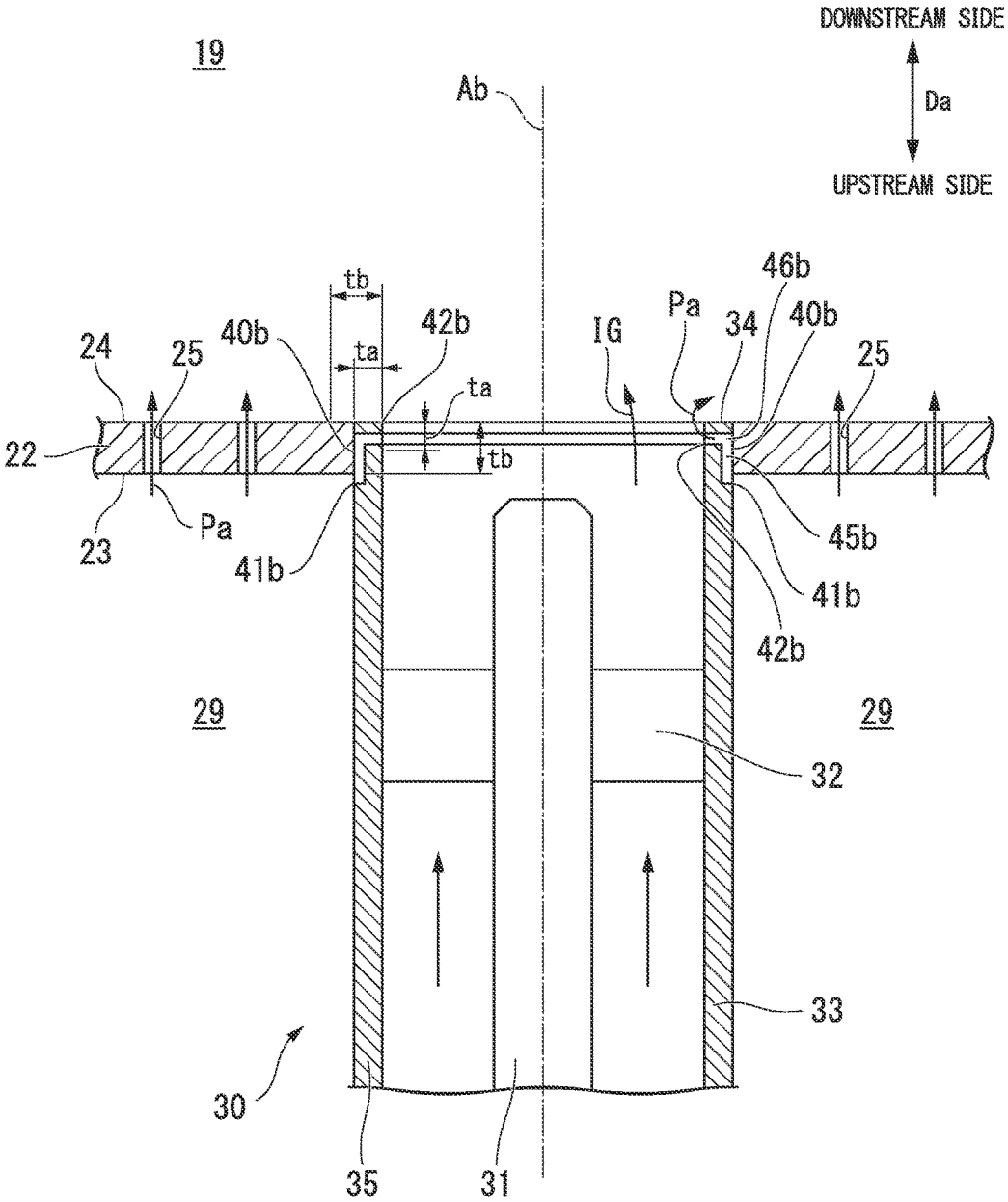
FIG. 8 is a sectional view of a combustor around a burner in a second modification of the present invention.

A second modification of the combustor in the above-described embodiment will be described using FIG. 8.

In the combustor of the present modification as well, only the shape of the purging air slit 40 in the combustor of the above embodiment is changed, and thus the other constitutions are the same as those of the combustor of the embodiment.

An inflow opening 41*b* of a purging air slit 40*b* in the present modification is formed in the outer circumferential surface of the burner case 33. An outflow opening 42*b* of the purging air slit 40*b* is formed in the inner circumferential surface of the burner case 33. The outflow opening 42*b* is formed within a second opening formation range that is the inner circumferential surface of the burner case 33 and ranges from the downstream end face 34 of the burner case 33 to a position corresponding to the plate thickness dimension to of the case forming plate 35 toward the upstream side.

The purging air slit 40*b* is formed with a first flow passage 45*b* and a second flow passage 46*b*. The first flow passage 45*b* extends in the case forming plate 35 from the inflow opening 41*b* toward the downstream side. The second flow passage 46*b* extends in the case forming plate 35 from a downstream end of the first flow passage 45*b* toward the radially inner side relative to the burner axis Ab, and has the outflow opening 42*b* as an opening. That is, like the first modification, the purging air slit 40*b* is also configured such that the flow passage within a virtual plane including the burner axis Ab is formed in a crank shape.

In the present modification, the purging air slit 40*b* is formed in the burner case 33, and further, the outflow opening 42*b* thereof is formed within the second opening formation range that is the inner circumferential surface of the burner case 33. Moreover, the second flow passage 46*b* having the outflow opening 42*b* as the opening extends toward the radially inner side relative to the burner axis Ab. For this reason, the purging air Pa from the purging air space 29 is injected from the second opening formation range, which is the inner circumferential surface of the burner case 33, into the burner case 33 toward the radially inner side. A flow of the purging air Pa is changed to a flow directed to the downstream side by the combustible gas IG flowing to the downstream side in the burner case 33. On the other hand, the combustible gas IG is pushed to the side adjacent to the burner axis Ab by the purging air Pa injected from the second opening formation range that is the inner circumferential surface of the burner case 33 toward the radially inner side. Therefore, in the present modification as well, like the embodiment described above, no vortexes of the combustible gas IG are substantially formed at the downstream side of the downstream end face 34 of the burner case 33, and the combustible gas IG injected from the burner case 33 can be inhibited from being spread in the radial direction relative to the burner axis Ab. Even if a part of the combustible gas IG injected from the burner case 33 drifts in the vicinity of the downstream end face 34 of the burner case 33, a combustible content of the combustible gas IG is diluted with the purging air Pa.

Therefore, in the present modification as well, the burner case 33 and the base plate 22 can be inhibited from being thermally damaged, and service lives thereof can be increased.

(Third Modification of Combustor)

Figure 9:
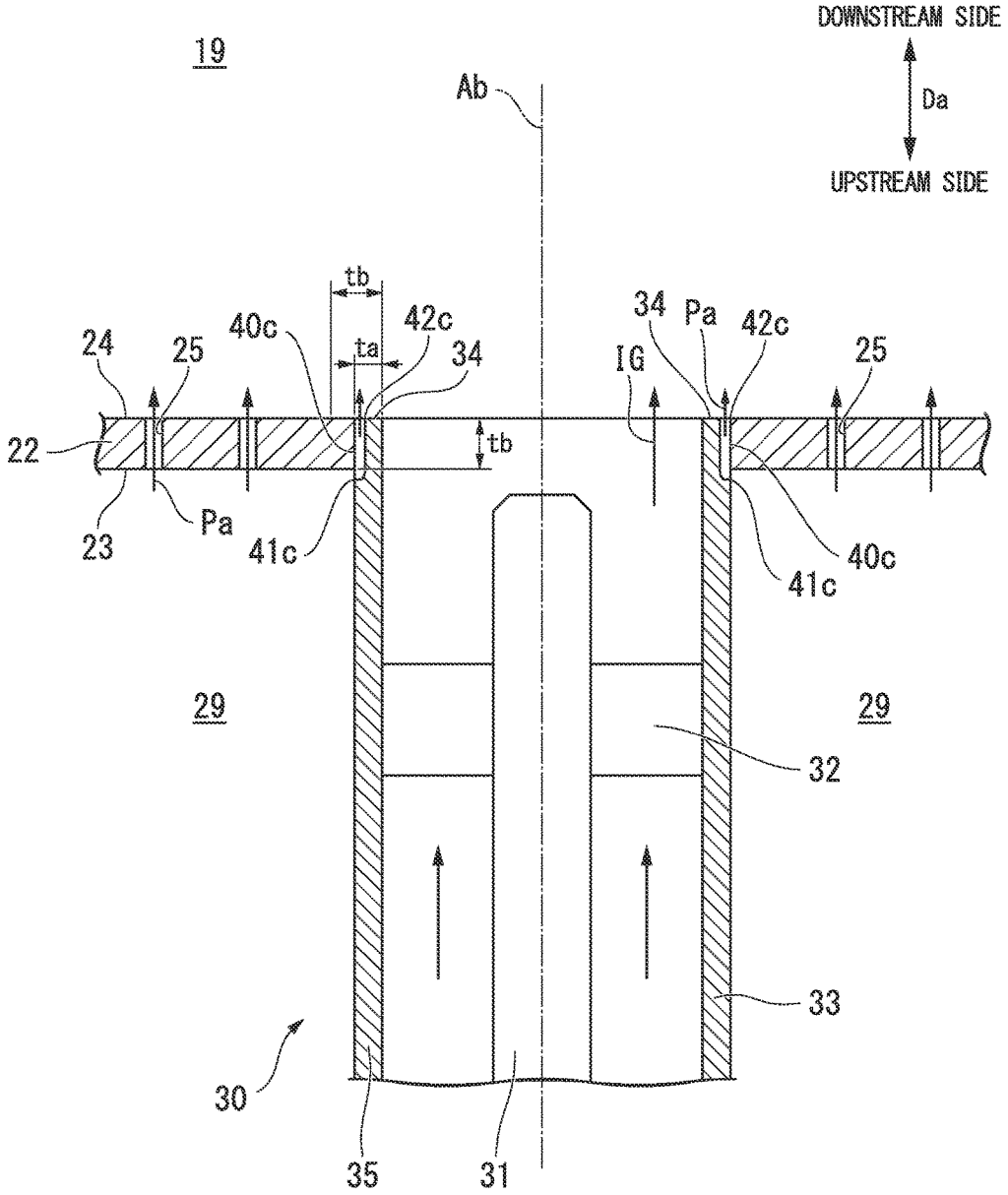
FIG. 9 is a sectional view of a combustor around a burner in a third modification of the present invention.

A third modification of the combustor in the above-described embodiment will be described using FIG. 9.

In the combustor of the present modification as well, only the shape of the purging air slit 40 in the combustor of the above embodiment is changed, and thus the other constitutions are the same as those of the combustor of the embodiment.

An inflow opening 41*c* of a purging air slit 40*c* in the present modification is formed in the outer circumferential surface of the burner case 33. Further, an outflow opening 42*c* of the purging air slit 40*c* is formed in the downstream end face 34 of the burner case 33. Therefore, like the above embodiment, the outflow opening 42*c* is formed within a second opening formation range from the inner circumferential surface of the burner case 33 to a position corresponding to the plate thickness dimension to of the case forming plate 35 in the radial direction.

The purging air slit 40*c* linearly extends in the case forming plate 35 from the inflow opening 41*c* toward the downstream side, and is formed only by a flow passage having the outflow opening 42*c* as an opening.

In the present modification, the purging air slit 40*c* is formed in the burner case 33, and further, the outflow opening 42*c* thereof is formed in the downstream end face 34 of the burner case 33. Moreover, the flow passage having the outflow opening 42*c* as the opening in the purging air slit 40*c* extends toward the downstream side. For this reason, the purging air Pa from the purging air space 29 is injected from the downstream end face 34 of the burner case 33 into the combustion zone 19 toward the downstream side. Therefore, in the present modification as well, like the embodiment and first modification described above, no vortexes of the combustible gas IG are substantially formed at the downstream side of the downstream end face 34 of the burner case 33, and the combustible gas IG injected from the burner case 33 can be inhibited from being spread in the radial direction relative to the burner axis Ab. Even if a part of the combustible gas IG injected from the burner case 33 drifts in the vicinity of the downstream end face 34 of the burner case 33, a combustible content of the combustible gas IG is diluted with the purging air Pa.

Therefore, in the present modification as well, the burner case 33 and the base plate 22 can be inhibited from being thermally damaged, and service lives thereof can be increased.

Also, in the present modification, since the purging air slit 40*c* is formed only by the flow passage that linearly extends in the case forming plate 35, the purging air slit 40*c* is formed in an easier way than the purging air slits 40*a* and 40*b* in the first and second modifications.

(Fourth Modification of Combustor)

Figure 10:
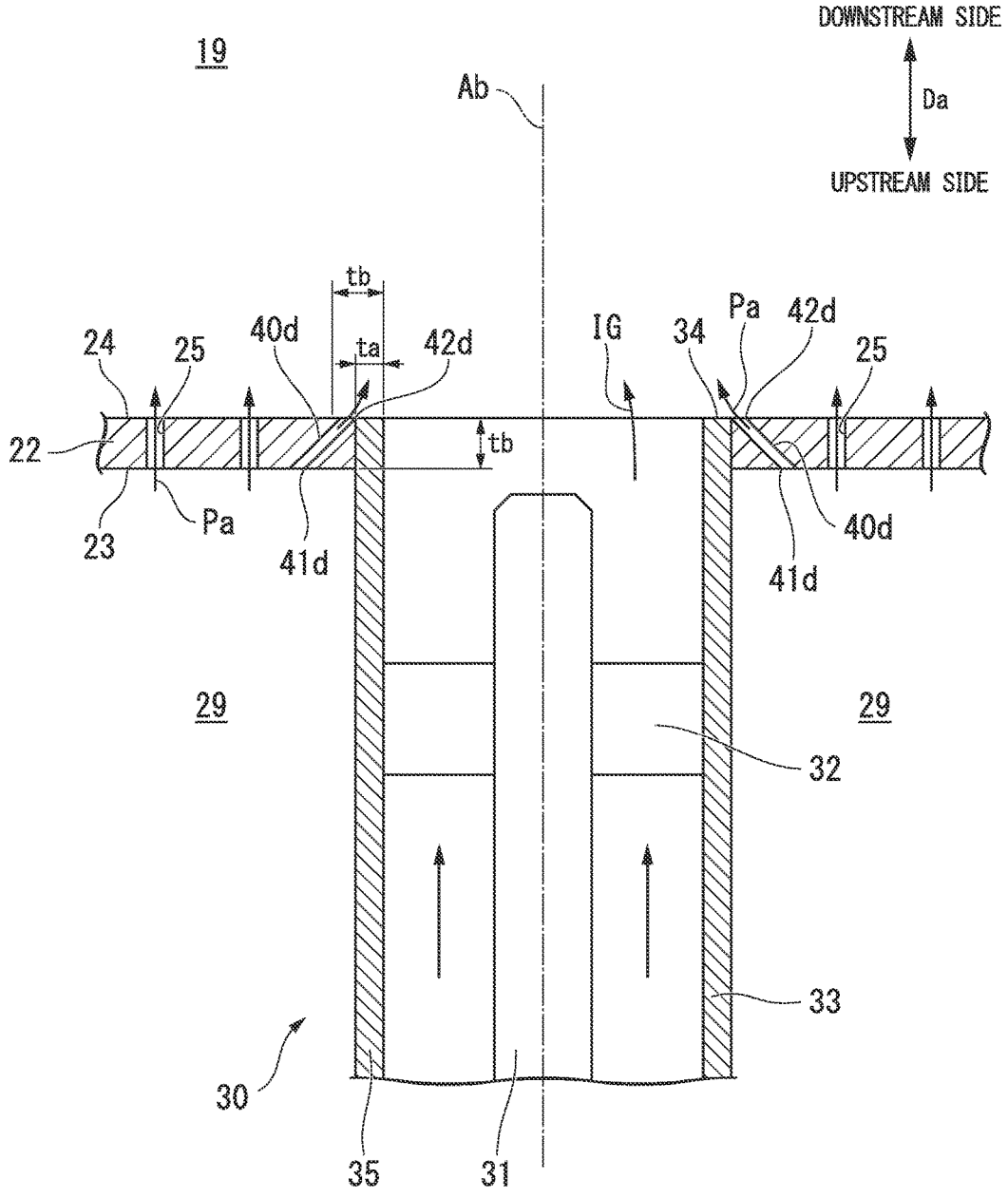
FIG. 10 is a sectional view of a combustor around a burner in a fourth modification of the present invention.

A fourth modification of the combustor in the above-described embodiment will be described using FIG. 10.

In the combustor of the present modification, only the layout of the purging air slit 40 in the combustor of the above embodiment is changed, and thus the other constitutions are the same as those of the combustor of the embodiment.

An inflow opening 41*d* of a purging air slit 40*d* in the present modification is formed in the upstream-side surface 23 of the base plate 22. An outflow opening 42*d* of the purging air slit 40*d* is formed in the downstream-side surface 24 of the base plate 22. The outflow opening 42*d* is formed within a first opening formation range that is the downstream-side surface 24 of the base plate 22 and ranges from the inner circumferential surface of the burner case 33 to a position corresponding to the plate thickness dimension tb of the base plate 22 in the radial direction. A flow passage within a virtual plane including the burner axis Ab of the purging air slit 40*d* is linear and gradually inclined to be nearer the burner axis Ab from the inflow opening 41*d* toward the outflow opening 42*d*.

In the present modification, the purging air slit 40*d* is formed in the base plate 22, and further, the outflow opening 42*d* thereof is formed within the first opening formation range that is the downstream-side surface 24 of the base plate 22. Moreover, the flow passage within the virtual plane including the burner axis Ab in the purging air slit 40*d* is gradually inclined to be nearer the burner axis Ab from the inflow opening 41*d* toward the outflow opening 42*d*. For this reason, the purging air Pa from the purging air space 29 is injected from the first opening formation range that is the downstream-side surface 24 of the base plate 22, in a direction gradually approaching the burner axis Ab toward the downstream side. Therefore, in the present modification, no vortexes of the combustible gas IG are substantially formed at the downstream side of the downstream end face 34 of the burner case 33, and the combustible gas IG injected from the burner case 33 can be inhibited from being spread in the radial direction relative to the burner axis Ab. Even if a part of the combustible gas IG injected from the burner case 33 drifts in the vicinity of the downstream end face 34 of the burner case 33, a combustible content of the combustible gas IG is diluted with the purging air Pa. In other words, the purging air Pa from the purging air slit 40*d* drifts in the vicinity of the downstream end of the burner case 33, and the combustible content of the combustible gas IG drifting in the vicinity of the downstream end of the burner case 33 is reduced. For this reason, in the present modification as well, the combustion of the combustible gas IG in the vicinity of the downstream end of the burner case 33 can be suppressed.

Thus, even if the outflow opening 42*d* of the purging air slit 40*d* is not formed within a second opening formation range, as long as the outflow opening 42*d* is formed within the first opening formation range wider than the second opening formation range, the combustion of the combustible gas IG in the vicinity of the downstream end of the burner case 33 can be suppressed. For this reason, in the present modification, the burner case 33 and the base plate 22 can be inhibited from being thermally damaged, and service lives thereof can be increased. Therefore, in the first, second and third modifications described above, and a fifth modification to be described below as well, the outflow opening of the purging air slit may be formed within the first opening formation range (Fifth Modification of Combustor)

Figure 11:
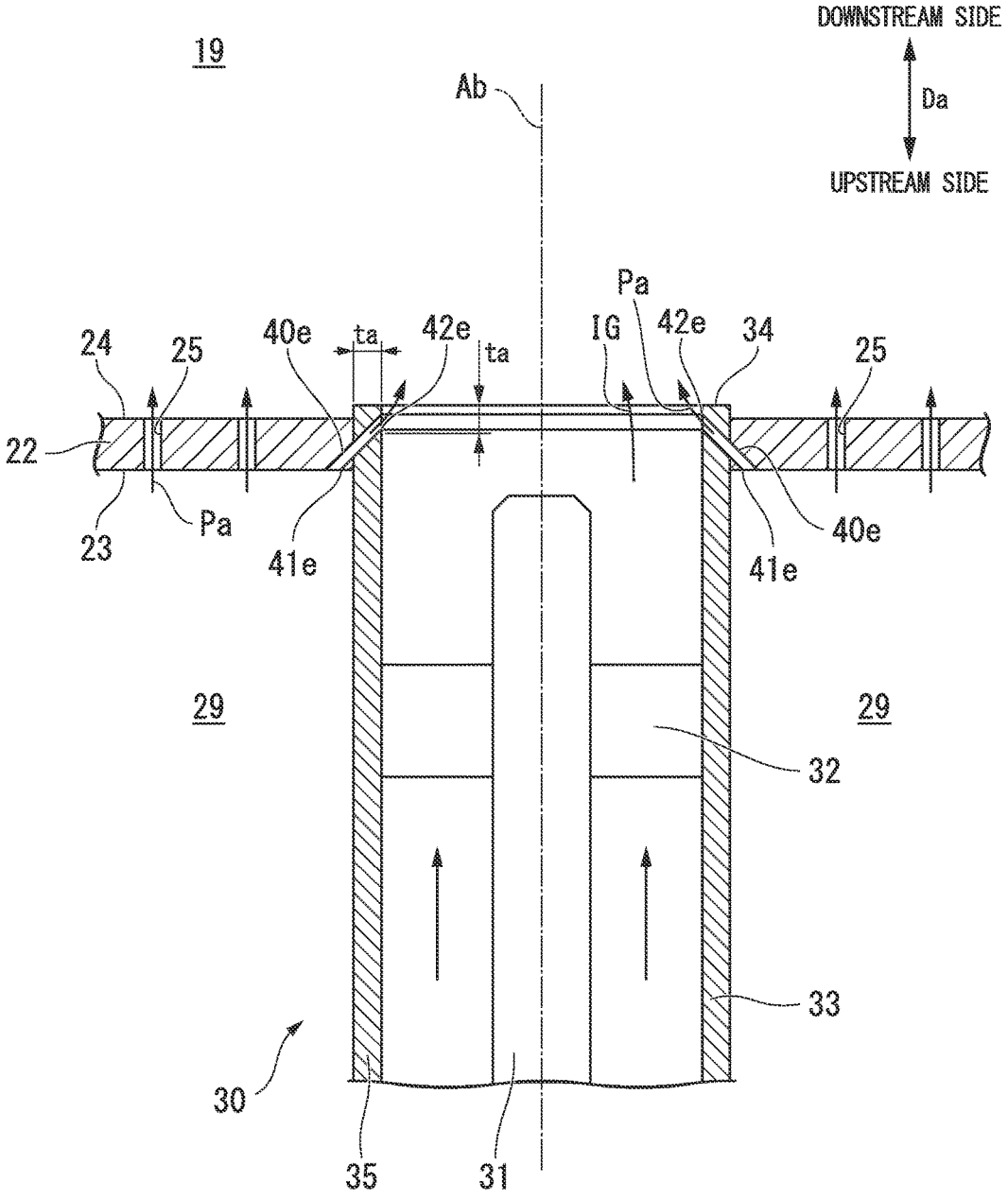
FIG. 11 is a sectional view of a combustor around a burner in a fifth modification of the present invention.

A fifth modification of the combustor in the above-described embodiment will be described using FIG. 11.

In the combustor of each of the embodiment and modifications described above, the downstream end face 34 of the burner case 33 and the downstream-side surface 24 of the base plate 22 are flush with each other. On the other hand, in the combustor of the present modification, the downstream end face 34 of the burner case 33 protrudes to the downstream side relative to the downstream-side surface 24 of the base plate 22.

An inflow opening 41*e* of a purging air slit 40*e* in the present modification is formed in the upstream-side surface 23 of the base plate 22. An outflow opening 42*e* of the purging air slit 40*e* is formed in the inner circumferential surface of the burner case 33. The outflow opening 42*e* is formed within a second opening formation range that is the inner circumferential surface of the burner case 33 and ranges from the downstream end face 34 of the burner case 33 to a position corresponding to the plate thickness dimension to of the case forming plate 35 toward the upstream side. A flow passage within a virtual plane including the burner axis Ab of the purging air slit 40*e* is linear and gradually inclined to be nearer the burner axis Ab from the inflow opening 41*e* toward the outflow opening 42*e*.

In the present modification, the purging air slit 40*e* straddling the burner case 33 from the base plate 22 is formed, and further the outflow opening 42*e* thereof is formed within the second opening formation range that is the inner circumferential surface of the burner case 33. Further, the flow passage within the virtual plane including the burner axis Ab in the purging air slit 40*e* is gradually inclined to be nearer the burner axis Ab from the inflow opening 41*e* toward the outflow opening 42*e*. For this reason, the purging air Pa from the purging air space 29 is injected from the second opening formation range that is the inner circumferential surface of the burner case 33, in a direction gradually approaching the burner axis Ab toward the downstream side. Therefore, in the present modification, no vortexes of the combustible gas IG are substantially formed at the downstream side of the downstream end face 34 of the burner case 33, and the combustible gas IG injected from the burner case 33 can be inhibited from being spread in the radial direction relative to the burner axis Ab. Even if a part of the combustible gas IG injected from the burner case 33 drifts in the vicinity of the downstream end face 34 of the burner case 33, a combustible content of the combustible gas IG is diluted with the purging air Pa.

As described above, even if the downstream end face 34 of the burner case 33 and the downstream-side surface 24 of the base plate 22 are not flush with each other, as long as the outflow opening of the purging air slit is formed within the second opening formation range or a first opening formation range wider than the second opening formation range, the burner case 33 and the base plate 22 can be inhibited from being thermally damaged, and service lives thereof can be increased. Therefore, in the above-described embodiment and first to fourth modifications as well, the downstream end face 34 of the burner case 33 and the downstream-side surface 24 of the base plate 22 do not have to be flush with each other.

(Sixth Modification of Combustor)

Figure 12:
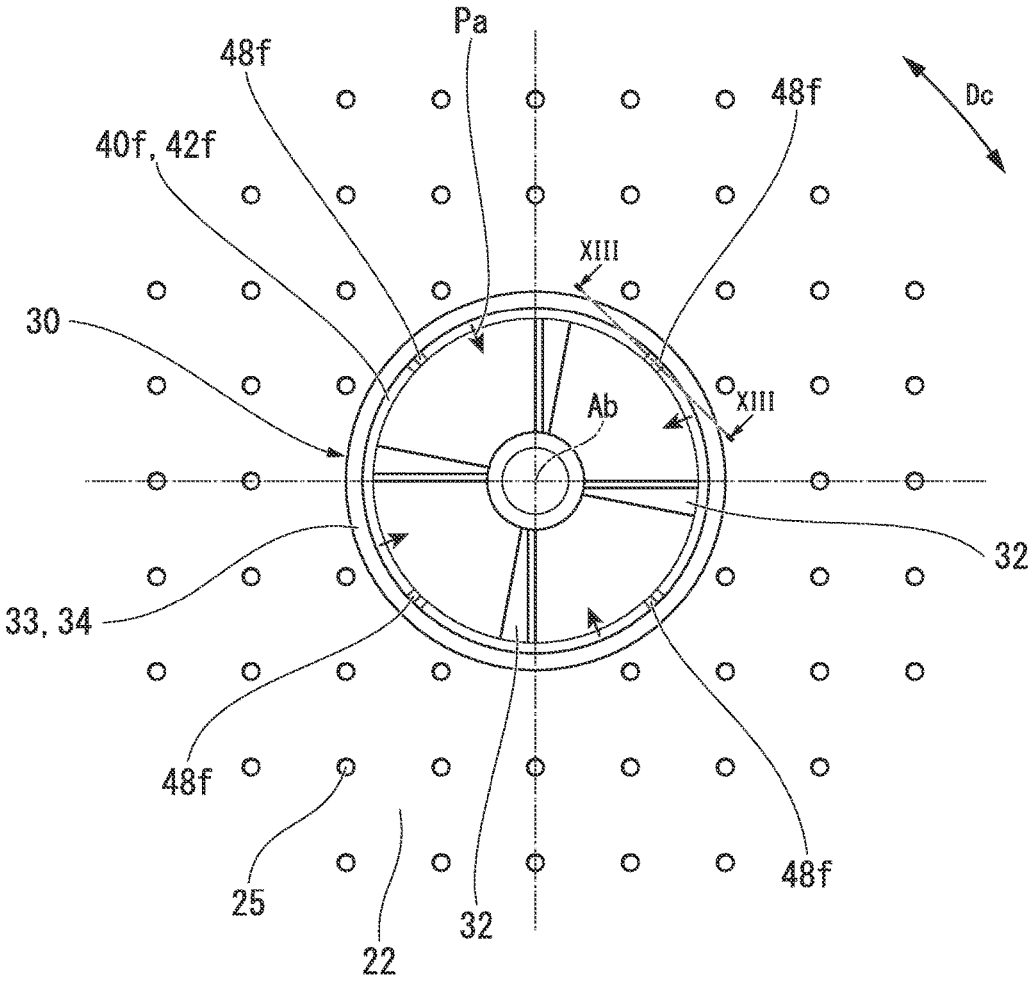
FIG. 12 is a front view of a burner in a sixth modification of the present invention.
Figure 13:
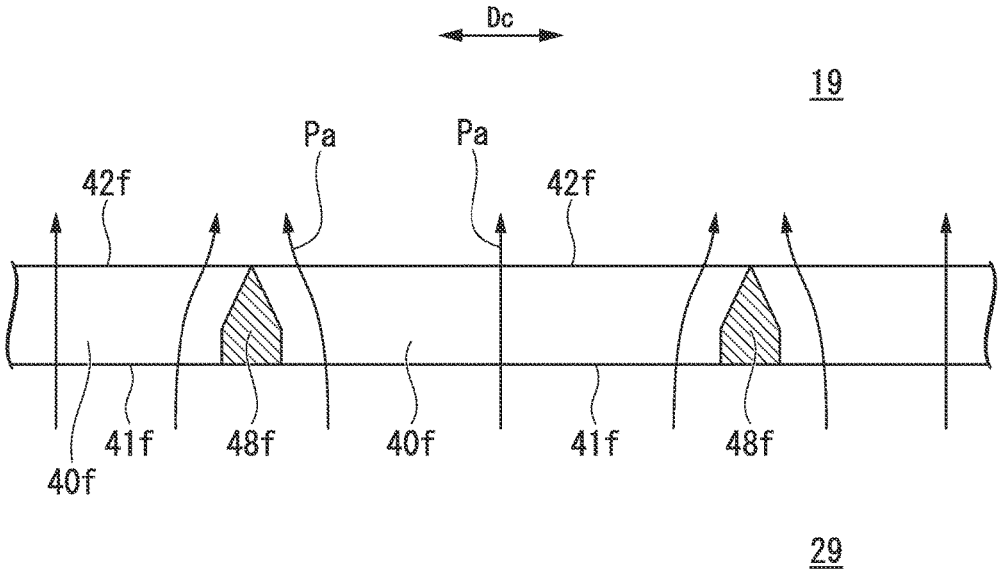
FIG. 13 is a sectional view taken along line XIII-XIII in FIG. 12.

A sixth modification of the combustor in the above-described embodiment will be described using FIGS. 12 and 13.

Both the inflow opening 41 and the outflow opening 42 of the purging air slit 40 in the above embodiment have the annular shapes centered on the burner axis Ab. On the other hand, both a plurality of inflow openings 41*f* and a plurality of outflow openings 42*f* of purging air slits 40*f* in the present modification are formed away from each other in a circumferential direction Dc centered on the burner axis Ab. Moreover, both the plurality of inflow openings 41*f* and the plurality of outflow openings 42*f* are each formed in a circular arc shape centered on the burner axis Ab. Therefore, the plurality of purging air slits 40*f* in the present modification are formed away from each other in the circumferential direction Dc centered on the burner axis Ab. A portion between each two of the plurality of purging air slits 40*f* in the circumferential direction Dc forms a spacer 48*f* for securing an interval between inner and outer circumferential edges of each inflow opening 41*f* having the circular arc shape and an interval between inner and outer circumferential edges of each outflow opening 42*f* having the circular arc shape.

Like the above embodiment, the inflow opening 41*f* of each purging air slit 40*f* in the present modification is formed in the upstream-side surface 23 of the base plate 22 (see FIG. 4). Also, like the above embodiment, the outflow opening 42*f* of each purging air slit 40*f* is formed in a corner of the downstream end of the burner case 33. A flow passage within a virtual plane including the burner axis Ab of the purging air slit 40*f* is linear and gradually inclined to be nearer the burner axis Ab from the inflow opening 41*f* toward the outflow opening 42*f*. Therefore, in the combustor of the present modification, only the spacers 48*f* are added to the combustor of the above embodiment, and thus the other constitutions are the same as those of the combustor of the embodiment.

Therefore, in the present modification as well, basically similarly to the above embodiment, the burner case 33 and the base plate 22 can be inhibited from being thermally damaged, and the service lives thereof can be increased.

In the present modification, since the spacers 48*f* are provided, it is possible to easily secure the interval between the inner and outer circumferential edges of each inflow opening 41*f* having the circular arc shape and the interval between the inner and outer circumferential edges of each outflow opening 42*f* having the circular arc shape.

However, since the spacers 48*f* are provided in the present modification, a small vortex is formed at a downstream side of each spacer 48*f*. The downstream side of each spacer 48*f* is the downstream side of a flow of the purging air Pa in each purging air slit 40*f*. Accordingly, it is preferable that the spacers 48*f* are reduced in width dimension in the circumferential direction Dc, or, as shown in FIG. 13, it is preferable that the spacers 48*f* are formed such that the width dimension in the circumferential direction Dc is gradually reduced toward the downstream side (side of the outflow opening 42*f*), to further reduce the vortexes formed at the downstream side of the spacers 48*f*.

In the present modification, both the plurality of inflow openings 41*f* and the plurality of outflow openings 42*f* are formed away from each other in the circumferential direction Dc centered on the burner axis Ab. However, only one openings of the inflow openings 41*f* and the outflow openings 42*f* may be formed away from each other in the circumferential direction Dc, and the other opening may be formed in an annular shape centered on the burner axis Ab.

In the present modification, the spacers 48*f* are added to the combustor of the above embodiment, but the same spacers may be added to the combustors of the first to fifth modifications.

In the present modification, the spacers 48*f* are arranged at regular intervals in the circumferential direction Dc. However, an area of the outflow opening per unit length in the circumferential direction Dc may be enlarged in a zone in which a fuel concentration distribution of the combustible gas IG in the circumferential direction Dc is relatively dense, compared to the other zone. Methods of enlarging the area of the outflow opening per unit length in the circumferential direction Dc include, for instance, a method of increasing an interval between the neighboring spacers 48*f*, and a method of reducing a thickness of the spacer 48*f* in the circumferential direction Dc. As a result, a flow rate of the purging air in the zone in which the fuel concentration distribution is relatively dense can be increased, and a possibility of flames being formed in the vicinity of the downstream end of the burner case 33 can be reduced.

To a similar effect, even if no spacers are provided and the outflow opening is formed in an annular shape, the area of the outflow opening per unit length in the circumferential direction Dc may be enlarged in the zone in which the fuel concentration distribution of the combustible gas IG in the circumferential direction Dc is relatively dense, compared to the other zone. The methods of enlarging the area of the outflow opening per unit length in the circumferential direction Dc include, for instance, a method of increasing a width of the outflow opening in the radial direction.

(Seventh Modification of Combustor)

A seventh modification of the combustor in the above-described embodiment will be described using FIG. 14.

In the above embodiment and modifications, as the purging air flow passage, the flow passage having an annular shape or the flow passages having a slit shape that are separated from each other are provided, but the purging air flow passage is not limited thereto. For example, as shown in FIG. 14, as the purging air flow passage, a plurality of purging air through-holes 40*g* separated from one another in the circumferential direction Dc centered on the burner axis Ab may be provided.

An outflow opening 42*g* of each purging air through-hole 40*g* in the present modification is formed in a corner of the downstream end of the burner case 33. The other constitutions are the same as those of the combustor of the above embodiment.

Accordingly, in the present modification as well, basically similarly to the above embodiment, the burner case 33 and the base plate 22 can be inhibited from being thermally damaged, and the service lives thereof can be increased.

In the present modification, in place of the purging air slit 40 acting as the purging air flow passage in above embodiment shown in FIGS. 4 and 5, the plurality of purging air through-holes 40*g* acting as the purging air flow passage are provided. However, in place of the purging air slit of the combustor of each of the first to sixth modifications, the plurality of purging air through-holes may be provided.

Figure 14:
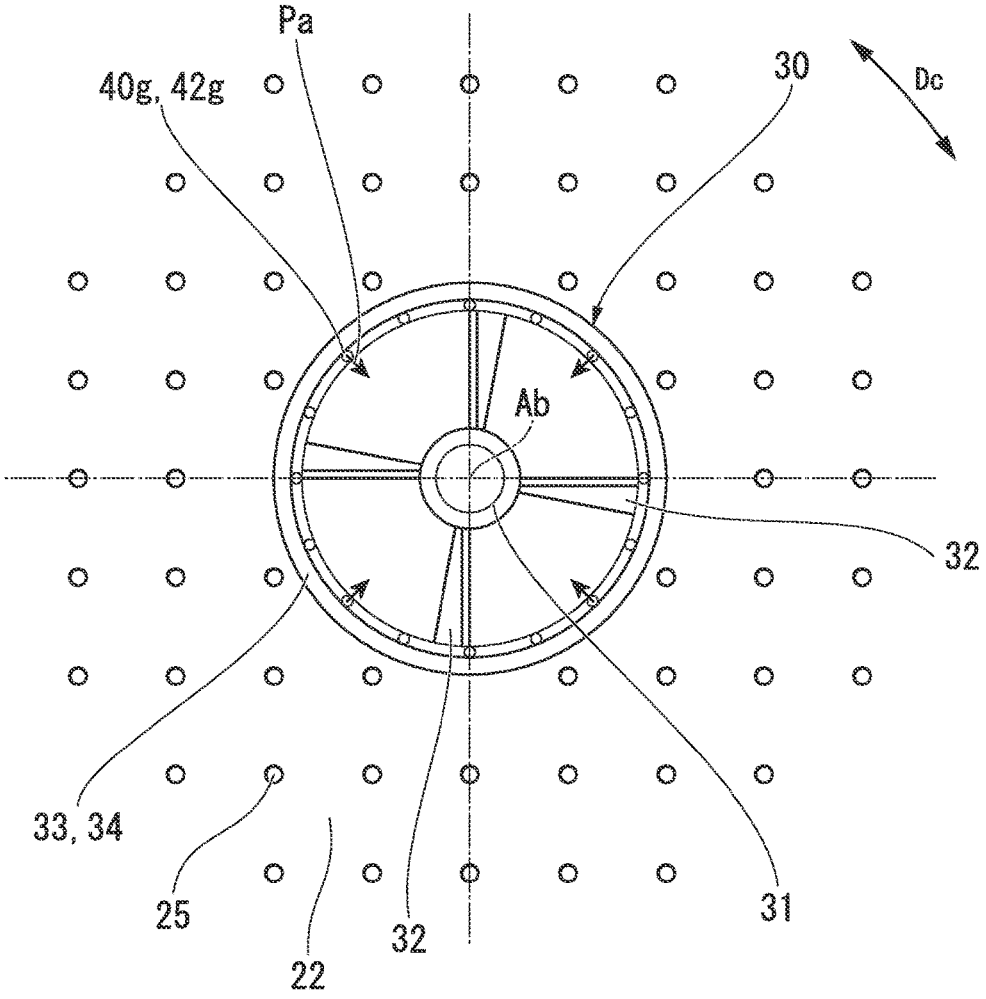
FIG. 14 is a front view of a combustor around a burner in a seventh modification of the present invention.

Further, in the present modification, as shown in FIG. 14, the purging air through-holes 40*g* and the outflow openings 42*g* are arranged with the same diameters as each other at regular intervals in the circumferential direction Dc. However, an area of the outflow opening per unit length in the circumferential direction Dc may be enlarged in a zone in which a fuel concentration distribution of the combustible gas IG in the circumferential direction Dc is relatively dense, compared to the other zone. Methods of enlarging the area of the outflow opening per unit length in the circumferential direction Dc include, for instance, a method of increasing a diameter of the purging air through-hole 40*g* and a diameter of the outflow opening 42*g*, and a method of increasing the number of purging air through-holes 40*g* and the number of outflow openings 42*g*. As a result, a flow rate of purging air in the zone in which the fuel concentration distribution is relatively dense can be increased, and a possibility of flames being formed in the vicinity of the downstream end of the burner case 33 can be reduced.

(Eighth Modification of Combustor)

Figure 15:
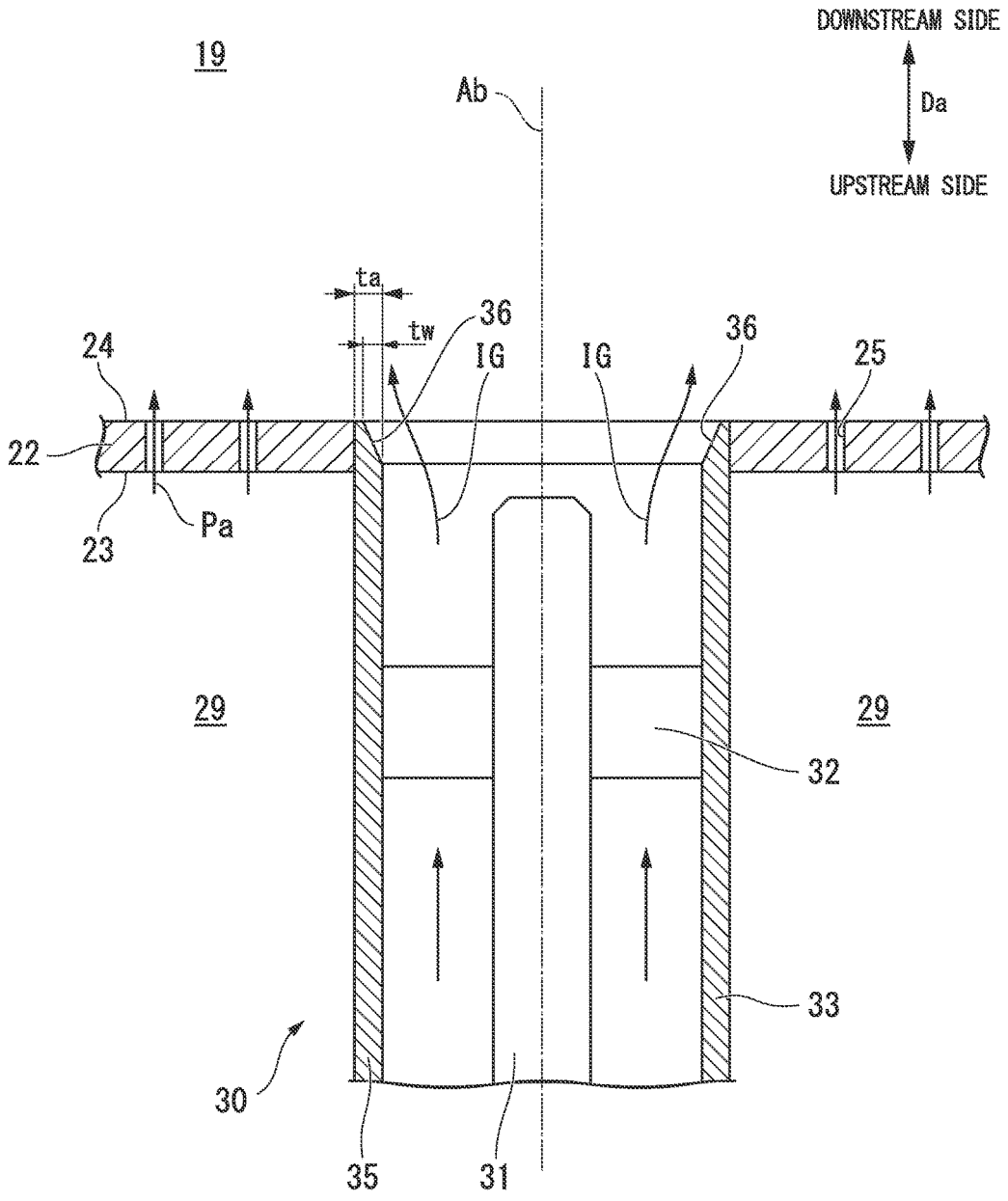
FIG. 15 is a sectional view of a combustor around a burner in an eighth modification of the present invention.

An eighth modification of the combustor in the above-described embodiment will be described using FIG. 15.

In the combustor of the present modification, a purging air slit is formed in neither the burner case 33 nor the base plate 22. Instead of this, in the combustor of the present modification, a tapered surface 36 is formed at the downstream end of the burner case 33 such that an inner diameter thereof is gradually increased toward the downstream side. A tapered surface formation width tw of the tapered surface 36 in a plate thickness direction of the case forming plate 35 forming the burner case 33 is equal to or more than half of the plate thickness to of a portion at which the tapered surface 36 is not formed in the case forming plate 35.

As in the present modification, as the tapered surface 36 is formed at the downstream end of the burner case 33, even just after the combustible gas IG inside the burner case 33 is injected from the burner case 33, most of the combustible gas IG smoothly flows toward the downstream side. For this reason, it is less likely that vortexes of the combustible gas IG are formed at the downstream side of the downstream end of the burner case 33, and a possibility of flames being formed in the vicinity of the downstream end of the burner case 33 can be reduced. For this reason, in the present modification as well, the burner case 33 and the base plate 22 can be inhibited from being thermally damaged, and service lives thereof can be increased.

Incidentally, the effect of suppressing generation of vortexes can be somewhat expected if the tapered surface 36, if ever so slightly, is formed at the downstream end of the burner case 33. However, if the tapered surface formation width tw of the tapered surface 36 in the plate thickness direction is less than half the plate thickness ta of the portion at which the tapered surface 36 is not formed in the case forming plate 35, the vortexes of the combustible gas IG are easily formed at the downstream side of the downstream end of the burner case 33. In addition, due to the vortexes, a possibility of flames being formed in the vicinity of the downstream end of the burner case 33 is increased.

In contrast, if the tapered surface formation width tw of the tapered surface 36 in the plate thickness direction is equal to or more than half the plate thickness ta of the portion at which the tapered surface 36 is not formed in the case forming plate 35, even if the vortexes of the combustible gas IG are formed at the downstream side of the downstream end of the burner case 33, their sizes are reduced. In this way, due to the small vortexes, a possibility of flames being formed in the vicinity of the downstream end of the burner case 33 is extremely reduced. For this reason, in the present modification, the tapered surface formation width tw of the tapered surface 36 in the plate thickness direction is set to be equal to or more than half the plate thickness to of the portion at which the tapered surface 36 is not formed in the case forming plate 35.

In the present modification, a shape of the tapered surface 36 is linear on a virtual plane that includes the burner axis Ab and crosses the tapered surface 36. However, as long as the tapered surface 36 is a surface on which the inner diameter of the burner case 33 is gradually increased toward the downstream side, the shape thereof may be curvilinear on a virtual plane that includes the burner axis Ab and crosses that surface.

The present modification is an example in which the purging air flow passage is formed in neither the burner case 33 nor the base plate 22. However, in the present modification as well, like the embodiment and first to seventh modifications above-described, the purging air flow passage may be formed in at least one of the burner case 33 and the base plate 22.

REFERENCE SIGNS LIST

1: compressor, 4: combustor, 5: turbine, 10: combustion liner, 11: combustion section, 15: combustion gas guide section, 19: combustion zone, 20: fuel injector, 22: base plate, 23: upstream-side surface, 24: downstream-side surface, 25: purging air hole, 29: purging air space, 30: burner, 31: nozzle, 32: swirl plate, 33: burner case, 34: downstream end face, 35: case forming plate, 36: tapered surface, 40, 40*a*, 40*b*, 40*c*, 40*d*, 40*e*, 40*f*: purging air slit (purging air flow passage), 40*g*: purging air through-hole (purging air flow passage), 41, 41*a*, 41*b*, 41*c*, 41*d*, 41*e*, 41*f*: inflow opening, 42, 42*a*, 42*b*, 42*c*, 42*d*, 42*e*, 42*f*, 42*g*: outflow opening, 48*f*: spacer, Ab: burner axis, Ac: combustor axis, Da: axial direction, Dc: circumferential direction, IG: combustible gas, Pa: purging air

What is claimed is:

1. A combustor comprising:

a nozzle centered on a burner axis and configured to inject fuel;

a burner case having a tubular shape, surrounding an outer circumference of the nozzle, and being configured to inject air and the fuel from the nozzle from an upstream side in an axial direction in which the burner axis extends to a downstream side; and a base plate spreading from a downstream end of the burner case in a radial direction based on the burner axis and defining a purging air space for purging air at an outer circumferential side of the burner case and an upstream side of the base plate, wherein:

a purging air flow passage for injecting the purging air from the purging air space into the burner case or to the downstream side is defined in the burner case, an inflow opening of the purging air flow passage for injecting the purging air is defined through a radially extending upstream-side surface of the base plate, and an outflow opening of the purging air flow passage for injecting the purging air is defined within at least one of:

(i) a radial range from an inner circumferential surface of the burner case to a shorter of a radial plate thickness of a case forming plate defining the burner case and a value corresponding to an axial plate thickness of the base plate, and (ii) an axial range from the downstream end of the burner case to a shorter of a value corresponding to the radial plate thickness of the case forming plate defining the burner case and the axial plate thickness of the base plate.

2. The combustor according to claim 1, wherein the outflow opening has an annular shape centered on the burner axis.

3. The combustor according to claim 1, wherein the outflow opening is one of a plurality of outflow openings defined so as to be away from each other in a circumferential direction centered on the burner axis.

4. The combustor according to claim 1, wherein:

the outflow opening is one of a plurality of outflow openings;

the inflow opening is one of a plurality of inflow openings;

the plurality of inflow openings and the plurality of outflow openings are defined so as to be away from each other in a circumferential direction centered on the burner axis;

the plurality of outflow openings are defined in a first circular arc shape centered on the burner axis; and the plurality of inflow openings are defined in a second circular arc shape centered on the burner axis.

5. The combustor according to claim 4, wherein:

a portion between each one of the plurality of outflow openings and a corresponding one of the plurality of inflow openings defines a spacer for securing an interval between: (i) inner and outer circumferential edges of the one of the plurality of outflow openings, and (ii) inner and outer circumferential edges of the corresponding one of the plurality of inflow openings; and a width of the spacer in the circumferential direction reduces toward the one of the plurality of outflow openings.

6. The combustor according to claim 1, wherein the outflow opening straddles the base plate and the burner case.

7. The combustor according to claim 1, wherein the purging air flow passage is inclined at a single angle toward the burner axis from a side of the purging air space to the outflow opening.

8. The combustor according to claim 1, wherein:

the downstream end of the burner case includes a tapered surface such that an inner diameter of the downstream end of the burner case is increases at a single angle toward the downstream side; and a tapered surface formation width of the tapered surface in a plate thickness direction of the case forming plate defining the burner case is equal to or more than half of a plate thickness of a portion at which the tapered surface is not formed in the case forming plate.

9. The combustor according to claim 1, wherein the base plate includes a plurality of purging air holes penetrating from the purging air space to the downstream side of the base plate.

10. The combustor according to claim 1, wherein an area of the outflow opening per unit length in a circumferential direction is enlarged in a zone in which a fuel concentration in the circumferential direction centered on the burner axis is highest at the downstream side of the burner case.

11. A gas turbine comprising:

the combustor according to claim 1;

a compressor configured to compress air and supply the air to the combustor; and a turbine configured to be driven by a combustion gas formed by combustion of the fuel in the combustor.

* * * * *